US008884716B2

(12) United States Patent
Choi et al.

(10) Patent No.: US 8,884,716 B2
(45) Date of Patent: Nov. 11, 2014

(54) FEEDING STRUCTURE FOR CAVITY RESONATORS

(75) Inventors: Joo-Young Choi, Munich (DE); Stefan Koch, Oppenweiler (DE); Thomas Merkle, Stuttgart (DE)

(73) Assignee: Sony Corporation, Tokyo (JP)

( * ) Notice: Subject to any disclaimer, the term of this patent is extended or adjusted under 35 U.S.C. 154(b) by 305 days.

(21) Appl. No.: 13/360,183

(22) Filed: Jan. 27, 2012

(65) Prior Publication Data

US 2012/0206219 A1 Aug. 16, 2012

(30) Foreign Application Priority Data

Feb. 14, 2011 (EP) ..... 11154368

(51) Int. Cl.
*H01P 5/107* (2006.01)

(52) U.S. Cl.
CPC ..... *H01P 5/107* (2013.01)
USPC ..... 333/26; 333/21 R

(58) Field of Classification Search
CPC ..... H01P 5/107; H01P 5/103; H01P 5/00
USPC ..... 333/21 R, 26, 33, 174, 230, 246, 248, 333/255
See application file for complete search history.

(56) References Cited

U.S. PATENT DOCUMENTS 6,509,883 B1 1/2003 Foti et al.
7,589,676 B2 9/2009 Popugaev et al.

OTHER PUBLICATIONS

Lee Harle, et al., "The effects of slot positioning on the bandwith of a micromachined resonator", 28th Euopean Microwave Conference Amsterdam, 1998, pp. 664-668.
Christophe A. Tavernier, et al., "A Reduced-Size Silicon Micromachined High-Q Resonator at 5.7 GHz", IEEE Transactions on Microwave Theory and Techniques, vol. 50, No. 10, Oct. 2002, pp. 2305-2314.
Bo Pan, et al., A High-Q Millimeter-Wave Air-Lifted Cavity Resonator on Lossy Substrates, IEEE Microwave and Wireless Components Letters, vol. 17, No. 8, Aug. 2007, pp. 571-573.
Joey R. Bray, et al., "Development of a Millimeter-Wave Ferrite-Filled Antisymmetrically Biased Rectangular Waveguide Phase Shifter Embedded in Low-Temperature Cofired Ceramic", IEEE Transactions on Microwave Theory and Techniques, vol. 52, No. 7, Jul. 2004, pp. 1732-1739.
Bo Pan, et al., Surface Micromachining Polymer-Core-Conductor Approach for High-Performance Millimeter-Wave Air-Cavity Filters Integration, IEEE Transactions on Microwave Theory and Techniques, vol. 56, No. 4, Apr. 2008, pp. 959-970.

(Continued)

*Primary Examiner* — Benny Lee
*Assistant Examiner* — Jorge Salazar, Jr.
(74) *Attorney, Agent, or Firm* — Oblon, Spivak, McClelland, Maier & Neustadt, L.L.P.

(57) ABSTRACT

A feeding structure including a carrier substrate, a top conductor plane of a cavity formed in the carrier substrate, a feedline substrate covering the top conductor plane, a signal conductor of a feedline, the signal conductor being formed in or on the feedline substrate opposite the top conductor plane, a via probe connected to the signal conductor and leading through the feedline substrate and the top conductor plane into the cavity, a ring-shaped aperture formed in the top conductor plane around the via probe, and at least one slot-shaped aperture formed in the top conductor plane starting at the ring-shaped aperture and leading away from the via probe.

11 Claims, 4 Drawing Sheets

(56) References Cited

OTHER PUBLICATIONS

Sangsub Song, et al., *W*-Bandpass Filter Using Micromachined Air-Cavity Resonator With Current Probes, IEEE Microwave and Wireless Components Letters, vol. 20, No. 4, Apr. 2010, pp. 205-207.

Michael J. Hill, et al., "A High-Q Reconfigurable Planar EBG Cavity Resonator", IEEE Microwave and Wireless Components Letters, vol. 11, No. 6, Jun. 2001, pp. 255-257.

Tze-Min Shen, et al., "Design of Vertically Stacked Waveguide Filters in LTCC", IEEE Transactions and Microwave Theory and Techniques, vol. 55, No. 8, Aug. 2007, pp. 1771-1779.

H. O. Scheck, "A Novel Method of Cavity Resonator Coupling to Microstrip Lines", Technical Research Centre of Finland, Telecommunications Laboratory, vol. 1, Sep. 9-12, 1991, pp. 807-811.

Kirankumar R. Hiremath, "Effect of the Slot Position on the Response of Slot Microresonators: Numerical Investigation", ICTON, Tu.C4.5, IEEE, 2010, pp. 1-3.

Jong-Hoon Lee, et al., "Comparative Study of Feeding Techniques for Three-Dimensional Cavity Resonators at 60 GHz", IEEE Transactionson Advanced Packaging, vol. 30, No. 1, Feb. 2007, pp. 115-123.

FEEDING STRUCTURE FOR CAVITY RESONATORS

CROSS-REFERENCE TO RELATED APPLICATIONS

The present application claims priority of European patent application 11154368.2 filed on Feb. 14, 2011.

FIELD OF THE INVENTION

The present invention relates to a feeding structure for cavity resonators. Further, the present invention relates to a microwave device.

BACKGROUND OF THE INVENTION

As one of the most preferred types of resonators for microwave devices, various cavity resonators have been realized in microwave packaging structures. If such cavity resonators are employed within packages, especially for filters, it is critical to achieve a sufficient coupling level from a feedline to the resonator since the amount of the achievable coupling defines the range of the bandwidth for which a microwave device can be designed. However, the design rules used for manufacturing often prevent structures from realizing the desired amount of coupling.

There are cavity resonators known, for instance from L. Harle et al. "The effects of slot positioning on the bandwidth of a micromachined resonator", in proceeding of 28$^{th}$ European Microwave Conference, 1998, pp. 664-668. Here, the cavity is fed by using slot coupling with a planar transmission line (feedline), such as a microstrip line. However, such a coupling is too weak and with this type of coupling, the bandwidth of a microwave device becomes too narrow for many applications.

To increase the amount of the coupling, other types of feeding structure for cavity resonators have been developed, e.g. from Lee et al. "Comparative study of feeding techniques for three-dimensional cavity resonators at 60 GHz", IEEE Transactions on Advanced Packaging, Vol. 30, No. 1, Feb. 2007, pp. 115-123. In such cavity resonators, for coupling between a cavity and its planar feedline a via probe is provided that reaches into the cavity with a gap from the bottom of the cavity since coupling from the slot and feedline is often too weak to obtain a critical coupling level for filter applications. However, a precise manufacturing of the via probe is ultimately required with additional layer masks to implement the gap.

When referring hereinafter to microwave frequencies, a frequency range from at least 0.3 GHz to 3 THz shall be generally understood, i.e. including frequencies commonly referred to as millimeter-wave frequencies.

BRIEF SUMMARY OF THE INVENTION

It is an object of the present invention to provide a feeding structure for cavity resonators which can increase the coupling, in particular the bandwidth, in the structure with limited design freedom due to process capability. It is a further object of the present invention to provide a corresponding microwave device.

According to an aspect of the present invention there is provided a feeding structure, in particular a feeding structure from a feedline to a cavity, for coupling said feedline to said cavity, said feeding structure comprising:

a carrier substrate, a top conductor plane of a cavity formed in said carrier substrate,—a feedline substrate covering said top conductor plane, a signal conductor of a fcedline, said signal conductor being formed in or on said feedline substrate opposite said top conductor plane, a via probe connected to said signal conductor and leading through said feedline substrate and said top conductor plane into said cavity, a ring-shaped aperture formed in said top conductor plane around said via probe, and at least one slot-shaped aperture formed in said top conductor plane starting at said ring-shaped aperture and leading away from said via probe.

According to a further aspect of the present invention there is provided a microwave device comprising a feedline, a cavity, and a feeding structure according to the present invention coupling said feedline to said cavity. Examples of such a microwave device are microwave resonators, microwave filters and antennas.

Preferred embodiments of the invention are defined in the dependent claims. It shall be understood that the claimed microwave device has similar and/or identical preferred embodiments as the claimed feeding structure and as defined in the dependent claims.

The present invention is based on the idea that the performance of cavity feeding using a via probe as, for instance, described in the above-cited paper of J.-H. Lee, can be maintained even without having the via gap by providing an at least one additional slot-shaped aperture in the top conductor plane, which starts at the ring-shaped aperture and leads away from the via probe. By said slot-shaped aperture, an additional E-field can be generated in the feeding structure and the bandwidth of the cavity resonator or the complete microwave device can be made wider, in particular sufficiently high to compensate the effect of the via gap. In total, the matching and the bandwidth can be enhanced in this manner.

Preferably, two slot-shaped apertures are formed in the top conductor plane leading away from the via probe in different directions, in particular in opposite directions, which further improve the coupling.

Still further, in a preferred embodiment the manufacturing difficulties that exist for the feeding structure described in the above-cited paper of J.-H. Lee can be overcome by increasing the length of the via probe such that it leads through the whole cavity (from top to bottom such that it directly touches the bottom conductor plane). Hence, no particular distance has to be exactly maintained between the end of the via probe and the bottom conductor plane. Thus, compared to the known devices, the number of layer masks can be saved the manufacturing process is much easier.

BRIEF DESCRIPTION OF THE DRAWINGS

These and other aspects of the present invention will be apparent from and explained in more detail below with reference to the embodiments described hereinafter. In the following drawings

DETAILED DESCRIPTION OF THE INVENTION

Figure 1A:
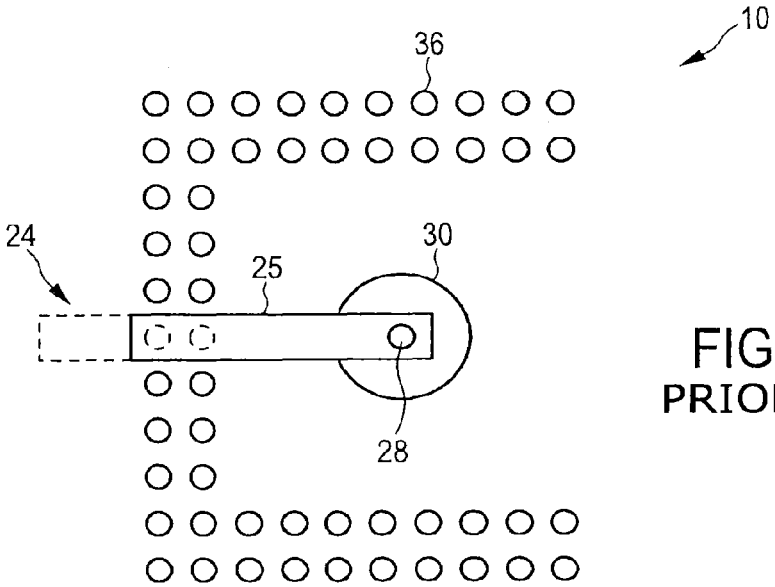
FIG. 1A PRIOR ART
FIGS. 1A and 1B show a top view and a side view of a known feeding structure.
Figure 1B:
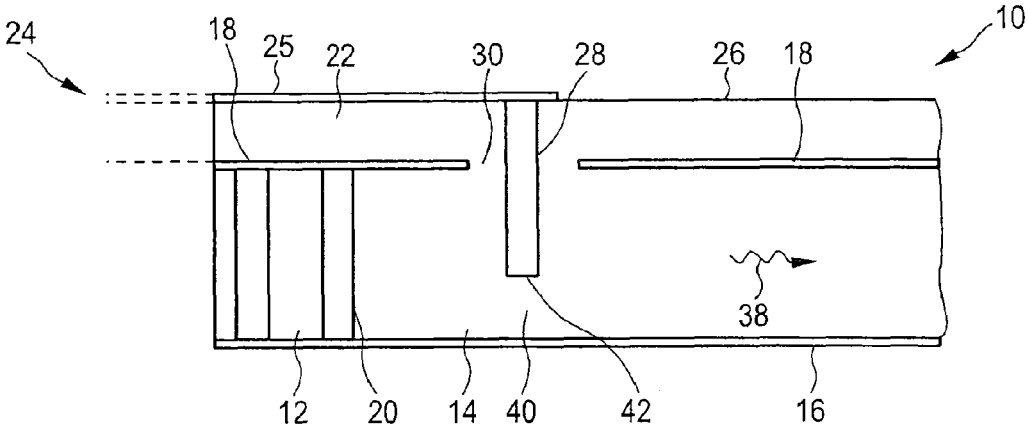
FIG. 1B PRIOR ART

FIG. 1 shows an embodiment of a known feeding structure 10 as described in the above-cited paper of J.-H. Lee. FIG. 1A shows a top view and FIG. 1B shows a side view. Said feeding structure 10 comprises a carrier substrate 12 in which a cavity 14 is formed, wherein the cavity may also be a waveguide or part of a waveguide. The walls of said cavity 14 are covered by conductor planes including a bottom conductor plane 16, a top conductor plane 18 (also called ground plane of the feedline 24) and a side wall conductor plane 20 (generally, substantially the walls of the complete cavity 14 are covered by conductor planes, i.e. there are further side walls of the cavity 14 covered with respective side wall conductor planes not shown in FIG. 1). The top conductor plane 18 is covered by a feedline substrate 22, which may be made of the same material as the carrier substrate 12. A signal conductor 25 of a feedline 24 (also called planar transmission line) is deposited on the outer surface 26 of said feedline substrate 22, i.e. opposite said top conductor plane 18. Said feedline 24 may generally be formed as a microstrip line, strip-line, CPW, etc. Further, said signal conductor 25 may also be buried in said feedline substrate 22, which is, however, not shown here. To said signal conductor 25 a via probe 28 is connected, which leads through said feedline substrate 22 and said top conductor plane 18 into said cavity 14. For this purpose, a ring-shaped aperture 30 is formed in said top conductor plane 18 around said via probe 28.

The top conductor plane 18 also serves as the ground plane of the signal conductor 25 which is formed in this embodiment as microstrip. Buried waveguide vias 36 are provided around said cavity 14 to form side walls (equivalently working as a closed conducting plane), which are common in the device fabricated using the known LTCC (Low Temperature Co-fired Ceramics) technology.

As indicated by 38 in FIG. 1B, energy (i.e. the microwave) is propagated into the cavity 14. In particular, the E-field is coupled from the feedline 24 into the cavity 14 formed by its conductor planes 16, 18, 20 through the via probe 28. The gap 40 between the lower end 42 of the via probe 28 and the bottom conductor plane 16 must be manufactured very precisely to have a precise size. Further, additional layer masks are required to form the gap 40.

Figure 2A:
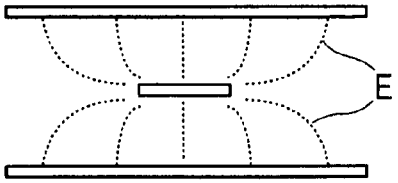
FIGS. 2A and 2B show the electric field distribution for a stripline and a microstrip line.
Figure 2B:
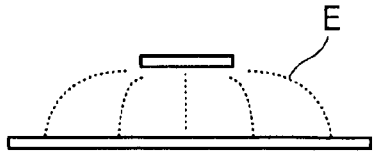

Often, when microwave devices using cavity resonators (e.g. cavity filters) are realized as a part of a packaging structure, a stripline is preferred as a feedline of the cavity resonator for complete shielding. Further, even other types of feedlines, e.g. microstrip lines or coplanar waveguides, can be provided as a stripline with accompanying shielding structures. However, the efficiency of a coupling from a feedline to a cavity is lower when using a stripline, as shown in FIG. 2A than with a microstrip line, as shown in FIG. 2B, due to the nature of the electric field distribution. The electric field distribution of such type of feedlines is shown in FIGS. 2A and 2B. Further, limited by the capability of the micromachining process, a diameter of a via is normally required to be greater than half of the cavity depth, while the diameter has a large effect on the amount of coupling. A via probe having a wide diameter associated with a stripline structure can severely reduce the amount of couplings so that it is difficult to achieve a desired bandwidth. Hence, there is a need to compensate for the reduced coupling when realizing a cavity resonator within a packaging structure.

Figure 3:
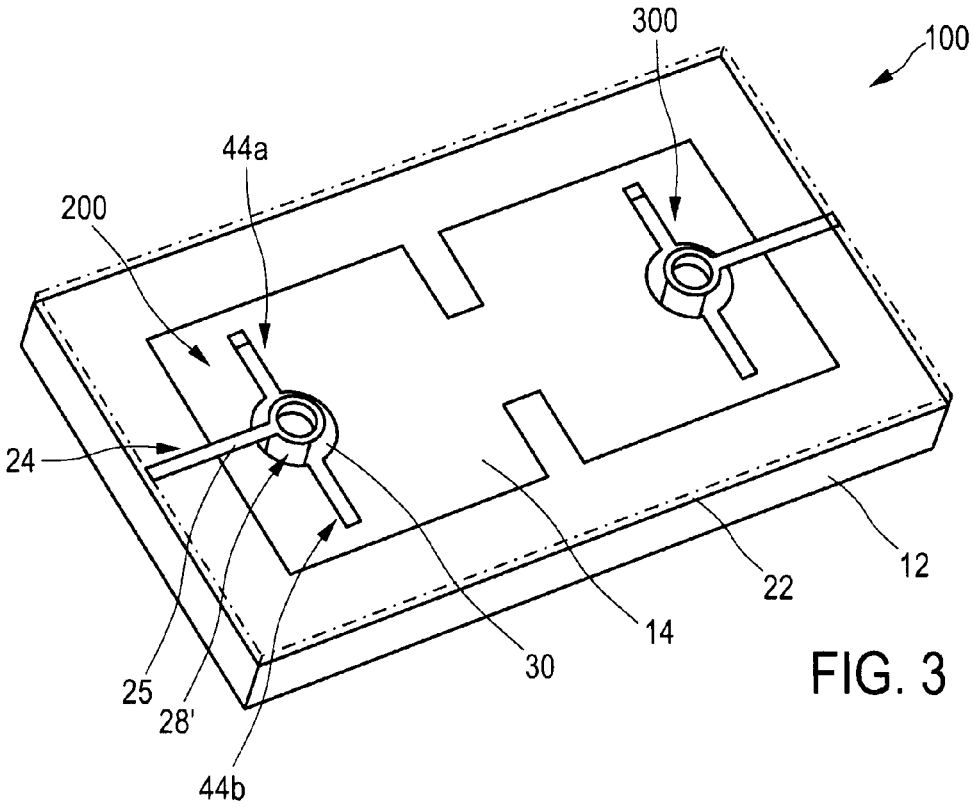
FIG. 3 shows a perspective view of an embodiment of a microwave device according to the present invention comprising two feeding structures.
Figure 4:
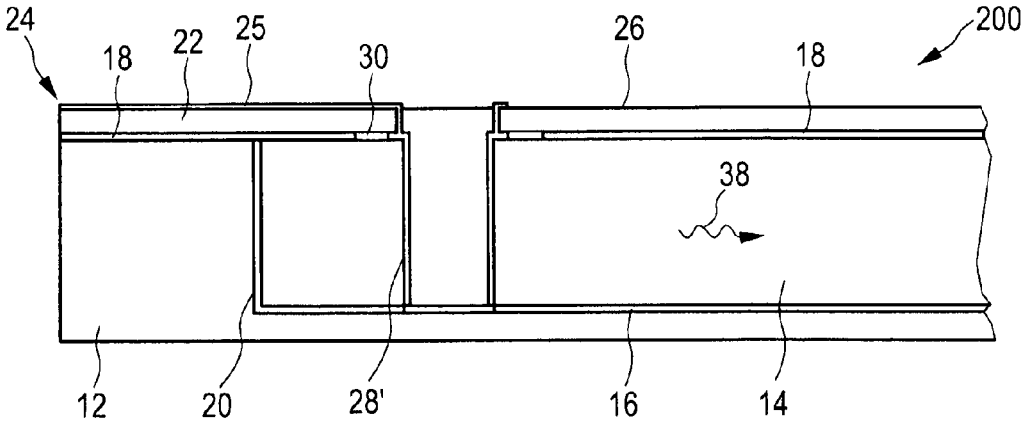
FIG. 4 shows a side view of an embodiment of a feeding structure according to the present invention.

FIG. 3 shows a perspective view of a microwave device 100 according to the present invention including two feeding structures 200, 300, which are generally identical. A side view of an embodiment of a feeding structure 200 for coupling the feedline to the cavity is shown in FIG. 4. The feeding structure 200 (and also the feeding structure 300) has many similarities to the known feeding structure 10 as shown in FIG. 1. Hence, for the same elements the same reference numerals have been used. In particular, as shown in FIG. 3, at two opposing sides of said cavity 14 the feeding structures 200, 300 are provided, i.e. as a kind of input coupling and output coupling.

A couple of essential differences, however, exist compared to the feeding structure 10 shown in FIG. 1. In particular, as shown in FIG. 4, the via probe 28' does not only extend into the cavity 14, but is leading through the cavity 14 down to the bottom conductor plane 16 with which it is in contact. This means that there is no gap in between and no exact size of a gap (40 in FIG. 1B) needs to be precisely manufactured as in the known feeding structure 10. Therefore, it can save the number of layer masks and makes manufacturing much easier.

Another essential difference is that according to the present invention the feeding structure 200 comprises at least one slot-shaped aperture 44 that is formed in the top conductor plane 18, starts at the ring-shaped aperture 30 and leads away from the via probe 28'. In the embodiment shown in FIGS. 3 and 4 the feeding structure 200 comprises two slot-shaped apertures 44*a*, 44*b* that lead away from the via probe 28' in different directions, in particular here in this embodiment in opposite directions.

Preferably, as shown in FIG. 3, the two slot-shaped aperture 44*a* and 44*b* are arranged in a direction perpendicular to the direction of the energy (wave) propagation 38 for the best performance (largest coupling), although arbitrary shapes, angles or numbers would be possible when necessary. Further, the length of the at least one slot-shaped aperture 44*a*, 44*b* is provided such that it ends within the top conductor plane 18 and does not extend up to the edge of the top conductor plane 18, i.e. does not extend beyond the cavity 14. In case that a longer slot is needed, it can he bent within the cavity area.

Figure 5A:
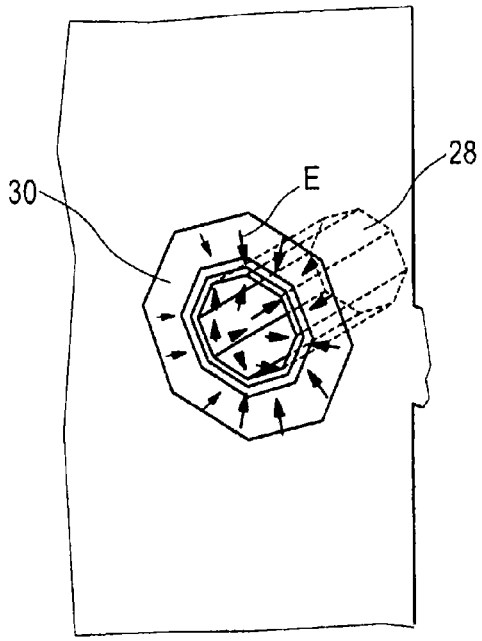
FIG. 5A PRIOR ART
FIGS. 5A and 5B show the E-field and H-field distribution around the via probe for a known feeding structure.
Figure 5B:
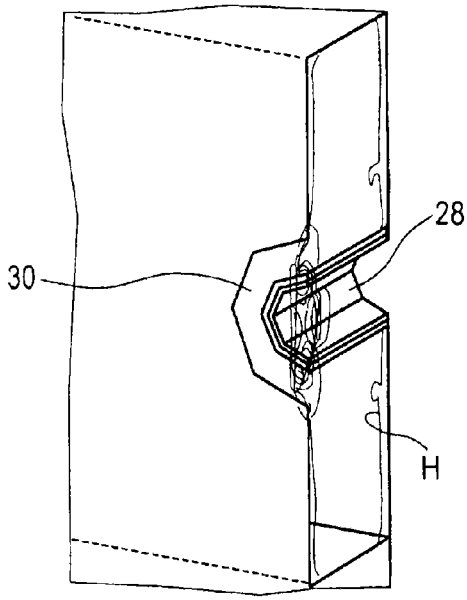
FIG. 5B PRIOR ART
Figure 6A:
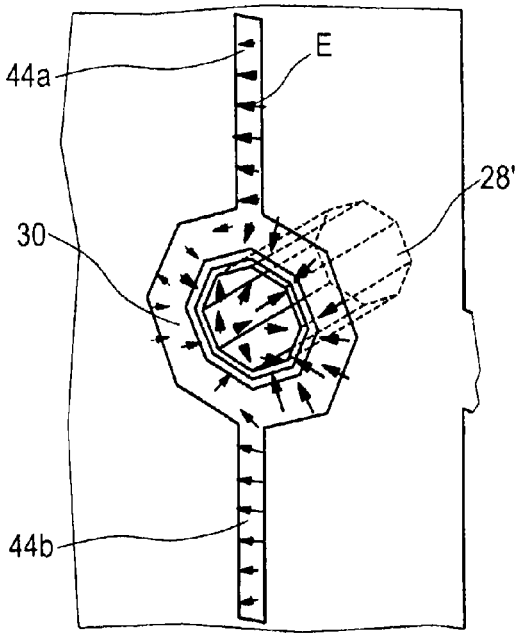
FIGS. 6A and 6B show the E-field and H-field distribution around the via probe for a feeding structure according to the present invention.
Figure 6B:
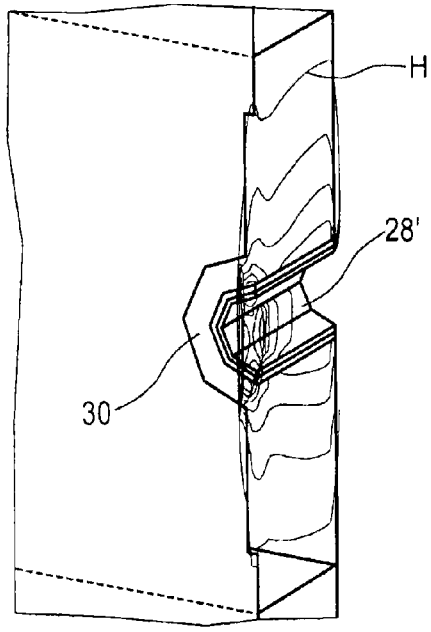

The one or more slot-shaped apertures 44*a*, 44*b* produce an additional electric field and, thus, induce more magnetic coupling between the feedline 24 and the cavity 14. Simulation results of the electromagnetic field demonstrate the induction of the additional magnetic coupling by the electric fields in the slot-shaped apertures as can be seen from FIGS. 5 and 6. FIGS. 5A and 5B show the electric field E and the magnetic field H around the via probe 28 of the known feeding structure, respectively and FIGS. 6A and 6B show the electric field and the magnetic field H around the via probe 28' of the feeding structure 200, respectively, as proposed according to the present invention.

Figure 7:
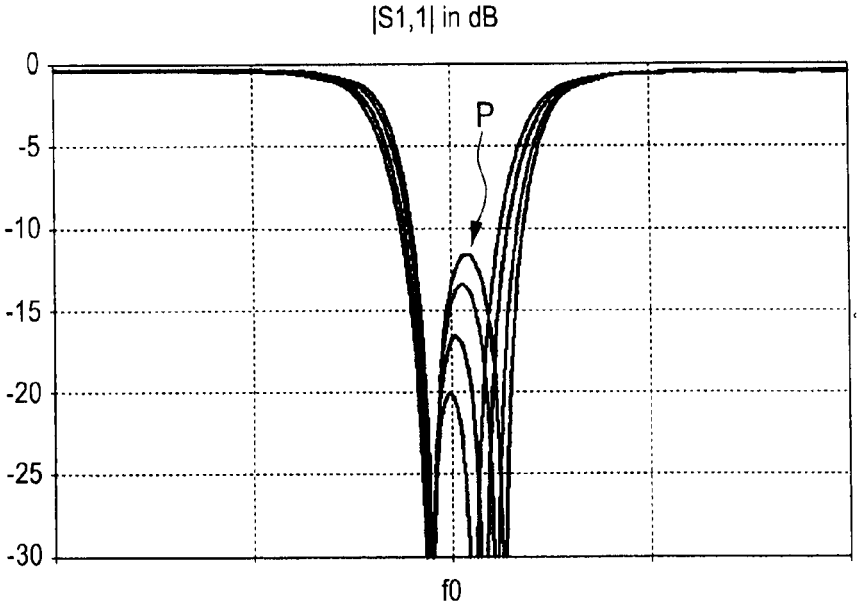
FIG. 7 shows simulation results for the return loss in dependence on the length of the slot-shaped aperture.

The at least one slot-shaped aperture thus provides additional coupling to compensate the reduced coupling due to removal of the gap 40. The length and width of the at least one slot-shaped aperture 44*a*, 44*b* can be optimized to maximize the coupling and matching in dependence on operating frequencies. FIG. 7 shows a diagram illustrating the return loss depending on the slot length. As can be seen, the minimum return loss P in the passband increases with increasing slot length.

Various modifications of the embodiments explained above can be envisaged. In particular, in an embodiment the via probe 28' may not necessarily extend through the complete cavity 14 until it contacts to the bottom conductor plane 16—like in the known microwave transition—to maintain a certain distance from the bottom conductor layer 16.

Preferably, as shown in the above embodiments, the via probe 28' is formed as a tube having a ring-shaped cross section, in particular a circular cross section. However, other forms of via probes may be employed as well, in particular having other cross sections such as a rectangular cross section.

Still further, preferably the via probe 28' is arranged in a direction perpendicular to the signal conductor 25. Alternatively, it may be possible that the via probe 28' is arranged in a different angular direction.

The via probe 28' is preferably formed at the end of the signal conductor 25 as shown in FIGS. 3 and 4 and no tuning stub is provided beyond the via probe 28'. However, in an alternative embodiment a tuning stub extending beyond the via probe 28 may also be provided in addition if needed.

Further, the signal conductor 25 has preferably the same direction as the direction of the energy (wave) propagation. However, the signal conductor 25 can be arranged at arbitrary angles to the direction or even bent with arbitrary shapes.

As shown particularly in FIG. 4, the top conductor plane 18 serves as a ground for the signal conductor 25 and thus extends beyond the cavity 14 at least beneath said signal conductor 25.

Still further, the cavity 14 can have other shapes than a square cuboid shown in the above embodiment, e.g. cube, cylinder, etc.

In summary, according to the present invention, the limit of coupling caused by the process capability can be overcome. A higher degree of the design freedom can be provided to stripline feeding structures. Further, the additionally provided slot-shaped aperture(s) can be used for fine tuning of the design, in particular of filter design. The length of the slot-shaped aperture has a linear effect on the increase of the coupling. Such a structure as proposed according to the present invention can also be easily realized without any additional manufacturing effort.

The invention has been illustrated and described in detail in the drawings and foregoing description, but such illustration and description are to be considered illustrative or exemplary and not restrictive. The invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A feeding structure comprising:

a carrier substrate;

a top conductor plane of a cavity formed in said carrier substrate;

a feedline substrate covering said top conductor plane;

a signal conductor of a feedline, said signal conductor being formed in or on said feedline substrate opposite said top conductor plane;

a via probe connected to said signal conductor and leading through said feedline substrate and said top conductor plane into said cavity;

a ring-shaped aperture formed in said top conductor plane around said via probe; and at least one slot-shaped aperture formed in said top conductor plane starting at said ring-shaped aperture and leading away from said via probe.

2. The feeding structure as claimed in claim 1, comprising:

the at least one slot -shaped aperture includes two slot-shaped apertures formed in said top conductor plane starting at said ring-shaped aperture and leading away from said via probe in different directions.

3. The feeding structure as claimed in claim 1, wherein said at least one slot-shaped aperture is arranged in a direction perpendicular to a direction of energy propagation of the feeding structure.

4. The feeding structure as claimed in claim 1, wherein said at least one slot-shaped aperture is formed only within said top conductor plane and does not extend beyond the edge of said top conductor plane up to a sidewall conductor plane of said cavity.

5. The feeding structure as claimed in claim 1, wherein said via probe extends through said cavity and is connected to a bottom conductor layer of said cavity.

6. The feeding structure as claimed in claim 1, wherein said via probe is formed at the end of said signal conductor.

7. The feeding structure as claimed in claim 1, wherein said via probe is formed as a tube having a ring-shaped cross section.

8. The feeding structure as claimed in claim 1, wherein said via probe is arranged in a direction perpendicular to said signal conductor of said feedline.

9. The feeding structure as claimed in claim 1, wherein said top conductor plane extends beyond said cavity at least beneath said signal conductor.

10. A microwave device comprising:

a feedline;

a cavity; and a feeding structure coupling said feedline to said cavity, said feeding structure comprising a carrier substrate;

a top conductor plane of said cavity formed in said carrier substrate;

a feedline substrate covering said top conductor plane;

a signal conductor of said feedline, said signal conductor being formed in or on said feedline substrate opposite said top conductor plane;

a via probe connected to said signal conductor and leading through said feedline substrate and said top conductor plane into said cavity;

a ring-shaped aperture formed in said top conductor plane around said via probe; and at least one slot-shaped aperture formed in said top conductor plane starting at said ring-shaped aperture and leading away from said via probe.

11. The microwave device as claimed in claim 10, wherein said cavity comprises a bottom conductor plane, the top conductor plane and sidewall conductor planes covering walls of said cavity.

* * * * *